United States Patent [19]

Wiggins et al.

[11] Patent Number: 4,802,818

[45] Date of Patent: Feb. 7, 1989

[54] SLURRY PUMP SUCTION SIDE LINER WITH REPLACEABLE COMPONENTS

[76] Inventors: Daniel Wiggins, 700 Homestead; Robert B. Flood, Jr., 13 Oakhill Dr., both of Marquette, Mich. 49855

[21] Appl. No.: 101,390

[22] Filed: Sep. 28, 1987

[51] Int. Cl.[4] ..... F04D 29/42

[52] U.S. Cl. ..... 415/170 A; 415/201; 415/197

[58] Field of Search ..... 415/170 A, 196, 197, 415/201, 219 C, 200

[56] References Cited

U.S. PATENT DOCUMENTS

| | | | |
|---|---|---|---|
| 1,727,703 | 9/1929 | Hause et al. | 415/201 X |
| 1,735,754 | 11/1929 | Hargis | 415/128 |
| 1,891,267 | 12/1932 | Milkowski | 415/196 X |
| 1,958,108 | 5/1934 | Miklowski | 415/196 |
| 2,021,346 | 11/1935 | Allen | 415/170 A X |
| 2,144,417 | 1/1939 | Schneible | 412/219 C |
| 2,163,464 | 6/1939 | Llewellyn | 415/173 R |
| 2,312,422 | 3/1943 | Kumlin et al. | 415/219 C |
| 3,020,850 | 2/1962 | Meckenstock | 415/197 X |
| 3,754,834 | 8/1973 | Wolters | 415/170 A X |
| 4,057,361 | 11/1977 | Renaud | 415/201 X |
| 4,099,890 | 7/1978 | Murakami et al. | 415/197 X |
| 4,527,948 | 7/1985 | Addie | 415/196 X |

*Primary Examiner*—Robert E. Garrett

*Assistant Examiner*—Joseph M. Pitko

*Attorney, Agent, or Firm*—Michael L. Bauchan

[57] ABSTRACT

A slurry pump suction side liner with replaceable components is provided utilizing separate suction port assembly, wear ring assembly, wear plate assembly and backing plate assembly components connected together to form a rigid suction side liner for directing a slurry into an impeller inlet. A replaceable annular wear ring having a first wear resistant surface facing the inlet axis and a second wear resistant surface at right angles to the inlet axis is provided to maintain a predetermined gap between gap between the impeller and replaceable wear ring to prevent slurry flow between the impeller and suction side liner assembly. An annular wear plate assembly having a wear resistant surface flush with the second wear resistant surface on the wear ring assembly is also provided to extend the gap radially outward from the wear ring, which is positioned between a suction port and the impeller. The wear ring and wear plate are each made in sections so the suction side liner may be removed and replacement made of the suction port or individual sections of the wear ring or wear plate as abrasion on the components by the slurry takes place without necessity of replacing the entire suction side liner. The wear ring and wear plate wear resistant surfaces are made of wear resistant carbide.

10 Claims, 9 Drawing Sheets

PRIOR ART

SLURRY PUMP SUCTION SIDE LINER WITH REPLACEABLE COMPONENTS

BACKGROUND OF THE INVENTION

This invention relates to pumps and pumping apparatus and in particular relates to pumps of that type which are used for transporting slurries, particularly slurries containing abrasive materials in a fluid in what is commonly called centrifugal pumps.

Slurries containing various fluids and abrasive particles, particularly slurries which need to be transported in the mining industry, are very destructive to pumps used to transport slurries. Centrifugal pumps commonly contain an impeller positioned in a pump casing which has an inlet defined by an axis common to the impeller. The slurry enters the casing and impeller along said axis and high speed rotation of the impeller changes the slurry flow direction 90 degrees into an annular outer pump chamber from which the slurry exits through a centrifugal pump outlet having an axis in a plane commonly positioned at right angles to the inlet axis and offset by approximately the radius of the pump. The portion of the pump which surrounds the inlet is commonly called the suction side liner and it is positioned a predetermined short distance away from the impeller suction side, the distance being so small as to substantially preclude slurry flow between the impeller and the suction side liner.

An abrasive slurry wears down the suction side liner adjacent the impeller, increasing the gap between the impeller and the suction side liner so as to permit slurry flow between the impeller and suction side liner and the irregular surface also causes irregular slurry flow patterns, the leakage and irregular flow reducing pump efficiency and causing premature pump failure.

Prior attempts at correcting suction side liner wear have been made, such as described in U.S. Pat. No. 4,527,948 issued July 9, 1985 to Graeme R. Addie in which a provision is made for periodically adjusting the axial position of the impeller by an adjustment screw so as to reduce the gap between the impeller and the suction side liner as wear takes place. Such a technique compensates for premature wear but does not prevent premature wear.

Highly wear resistant materials such as ceramics are in common usage in various industries, but ceramics are extremely expensive and difficult to make in large pieces due to manufacturing concerns such as high pressure required for the manufacturing process so less expensive materials have been in common usage in suction side liners, which continue to suffer excessive wear prematurely.

SUMMARY OF THE INVENTION

According to the present invention a slurry pump suction side liner with replaceable components is provided in which a suction side liner assembly is made of several small assemblies which are selectively connected together to form a rigid suction side liner assembly in which the locations of greatest wear are made of highly wear resistant materials such as ceramics and alloys and those wear resistant surfaces may be made in small sections to facilitate in expensive manufacturing of the ceramic and alloy materials with each section being easily replaceable. This has been accomplished by providing a suction port assembly having a passageway defined by the axis of a centrifugal pump impeller through which a slurry flows to the impeller, a wear ring assembly between the suction port assembly and the impeller, the wear ring assembly having highly wear resistant wear rings made of ceramic materials postioned at the most wear resistant location in the pump, being between the suction port assembly and the impeller where the slurry enters the impeller, the wear ring being positioned a predetermined distance from the impeller so as to form a gap between the impeller and the wear ring which is so small as to preclude substantial slurry flow between the wear ring. The suction side liner assembly includes an annular wear plate assembly around the perimeter of the wear ring assembly so as to extend the gap between the impeller and the suction side liner assembly radially outward to the outer chamber of the centrifugal pump, the wear plate assembly including a wear resistant surface flush with the wear ring wear resistant surface. Both the wear ring and the wear plate are made in sections which are each bolted to a backing plate assembly to which the suction port assembly is also attached so as to form a rigid suction side liner assembly. Individual components may each be replaced by unbolting warn components and replacing them while retaining in use those components which are not warn.

BRIEF SUMMARY OF THE DRAWINGS

FIG. 4 is an enlarged assembly drawing of the suction side liner assembly in FIG. 3 in which FIG. 4A is the wear plate assembly, FIG. 4B is the wear ring assembly, FIG. 4C is the backing plate assembly, FIG. 4D is the suction port assembly, and FIG. 4E shows the hold down clamps.

DESCRIPTION OF THE PREFERRED EMBODIMENT

Figure 1:
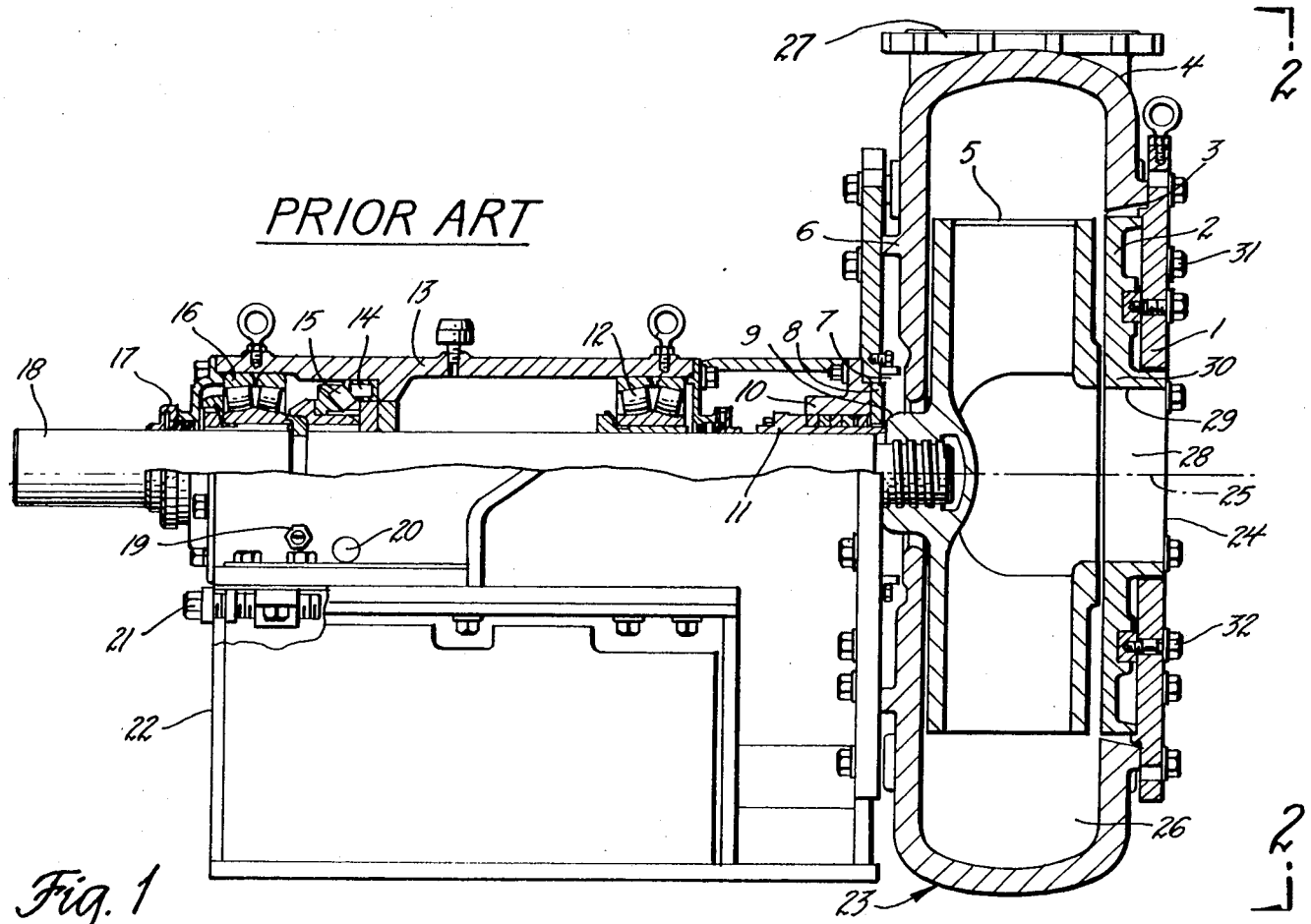
FIG. 1 is a plan view of a centrifugal pump of a conventional configuration of the type for which the slurry pump suction side liner with replaceable components was invented to utilize in place of the single piece suction side liner in the conventional pump.

For background purposes FIG. 1 illustrates a typical centrifugal pump of the type which is in common usage for transporting slurries, the FIG. 1 pump being one manufactured by Georgia Iron Works Company, some of its component parts being: suction plate 1; suction side liner 2 which is held in place by suction plate 1, which is a non-wear part which forms a part of the pump casing, snap ring gasket 3, which seals the suction side opening and prevents abrasive wear failure, pump casing 4, impeller 5, a rabbet fit 6 between pump sections, hub gasket 7, stuffing box wear plate 8, gaskets 9, gland 10, shaft sleeve 11, oil seals 12, split cartridge bearing assembly 13, spring retainer ring 14, thrust bearings 15, radial bearings 16, flingers 17, shaft 18, oil sight glass 19, oil temperature gauge 20, adjusting screw 21 for adjusting the clearance between the impeller 5 and the suction liner 2 when the suction liner 2 wears due to abrasive slurries passing through the pump, and pedestal 22.

The pump in FIG. 1, which may generally be referred to by the numeral 23 is typical of the centrifugal pumps which heretofore been used to transport slurries which enter the pump 23 through inlet 24 which may be defined by an axis 25. As the slurry enters the impeller 5 which is rotated on the axis 25 the slurry is thrown radially outward into an outer chamber 26 from which it exits through pump outlet 27.

It is particularly noteworthy that greatest wear of the suction side liner 2 takes place in passageway 28 on a first surface 29 adjacent passageway 28 and on a second surface 30 which extends radially outward from axis 25 and which is designed to be a predetermined distance from impeller 5 so as to have a predetermined gap between impeller 5 and suction side liner 2 which is insufficient to permit any significant slurry flow passing through the gap between impeller 5 and suction side liner 2.

The pump in FIG. 1 may have a suction side liner 2 of steel but it is made of a single large unit which is impractical to manufacture entirely of a highly wear resistant material such as ceramic or an alloy.

Figure 2:
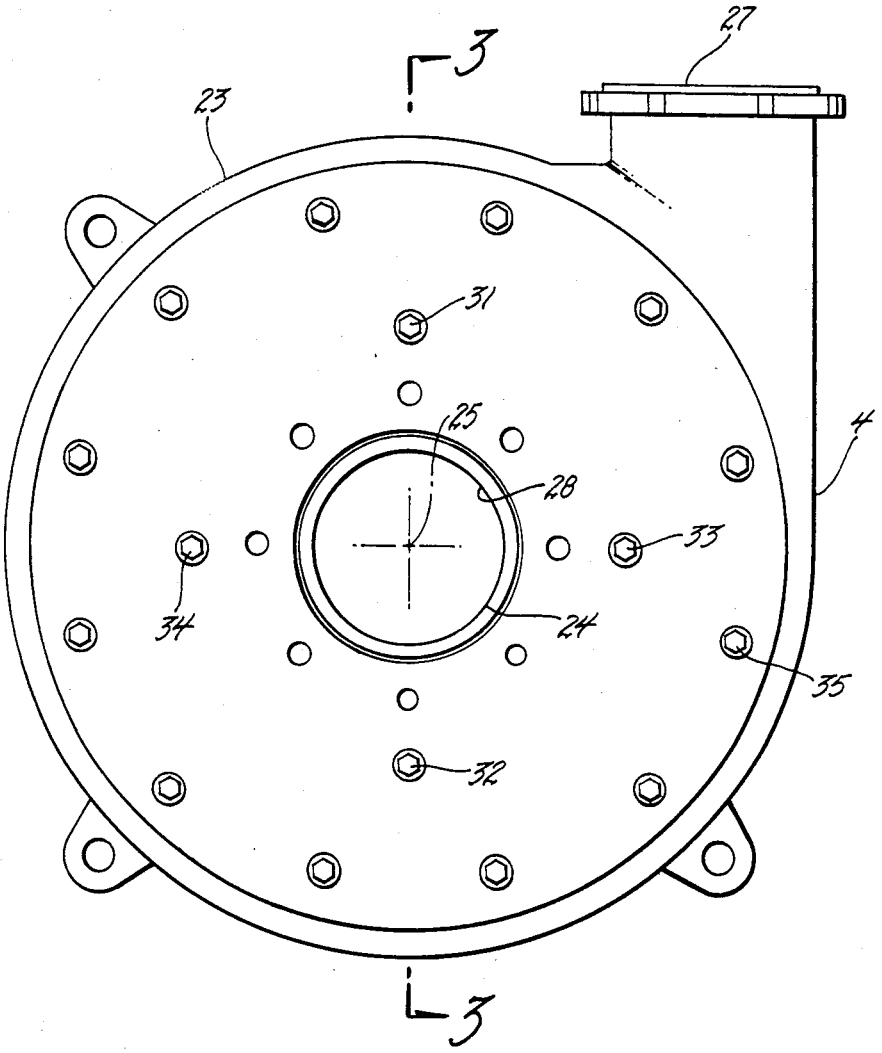
FIG. 2 is an end plan view of a centrifugal pump like that shown in FIG. 1 showing the means of attaching a pump casing together to support a suction side liner.

FIG. 2 is a plan view of the pump in FIG. 1 taken along line 2—2. As shown in FIGS. 1 and 2, bolts 31–34 secure the suction side liner to the suction plate 1. A circle of bolts 35 secures the suction plate 1 to the shell 4 of the pump casing.

Figure 3:
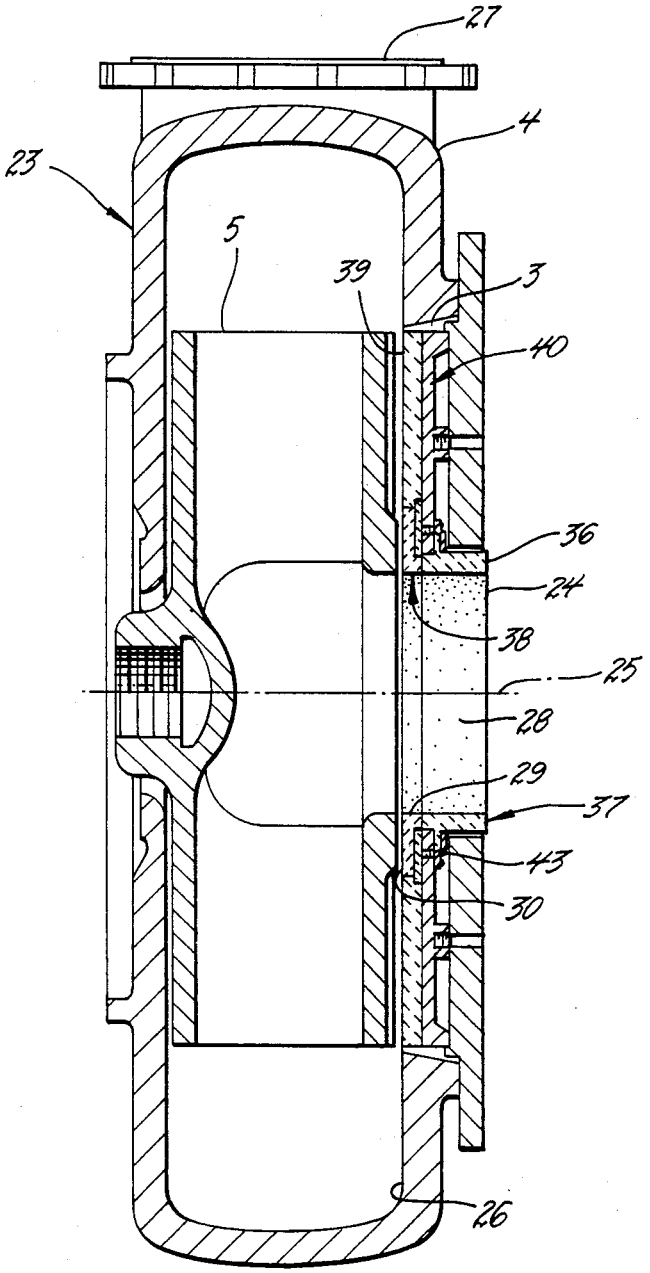
FIG. 3 is a cross section view of the pump in FIG. 2 taken along line 3—3 showing the cross section of the slurry pump suction side liner with replaceable components embodying the principals of the subject invention.

FIG. 3 is a section view of the pump 23 in FIG. 2 taken along line 3—3 and shows the detail of the subject invention. In FIG. 3 a slurry pump suction side liner assembly 36 which includes a suction port assembly 37, a wear ring assembly 38, a wear plate assembly 39, and a backing plate assembly 40.

Figure 4:
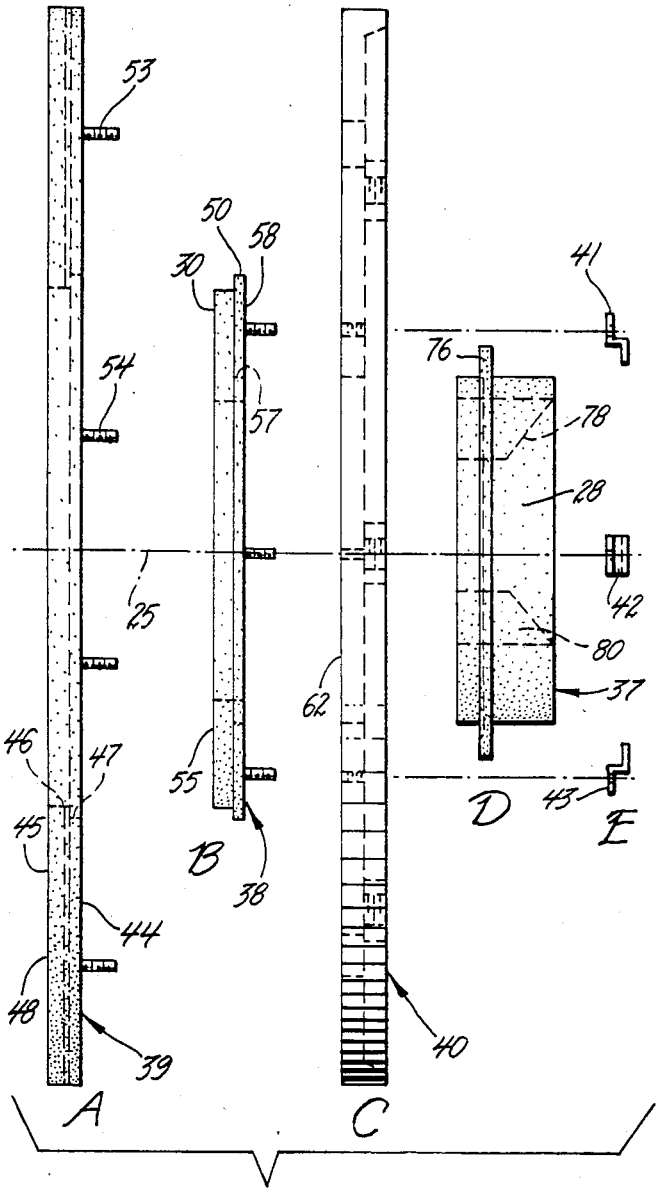
Figure 5:
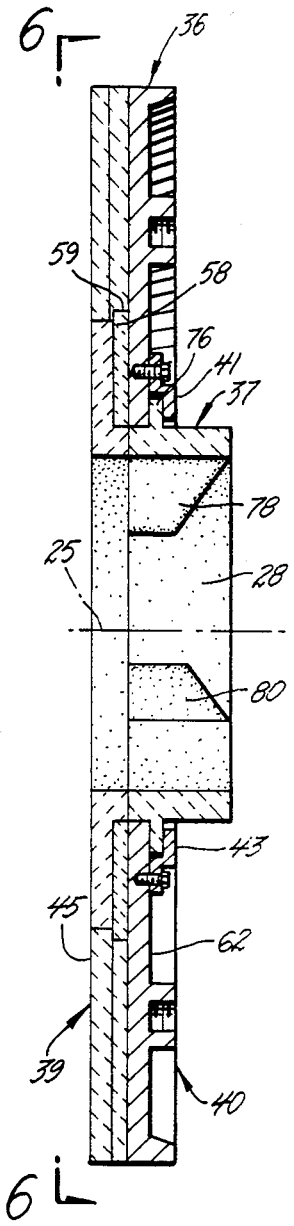
FIG. 5 is an enlarged cross section view of the suction side liner assembly in FIG. 4 with the various subassemblies connected together.
Figure 11:
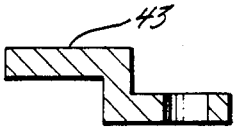
FIG. 11 is a section view of the hold down clamp in FIG. 10 in the backing plate assembly taken along line 11—11.

The details of the suction side liner assembly 36 in FIG. 3 are best illustrated in the enlarged views in FIGS. 4 and 5. FIG. 4 is an assembly drawing of the suction side liner assembly 36 in which FIG. 4A is the wear plate assembly 39, FIG. 4B is the wear ring assembly 38, FIG. 4C is the backing plate assembly 40, FIG. 4D is the suction port assembly 37, and FIG. 4E shows three of the four hold down clamps 41–43, details of which are illustrated in FIG. 11.

Figure 6:
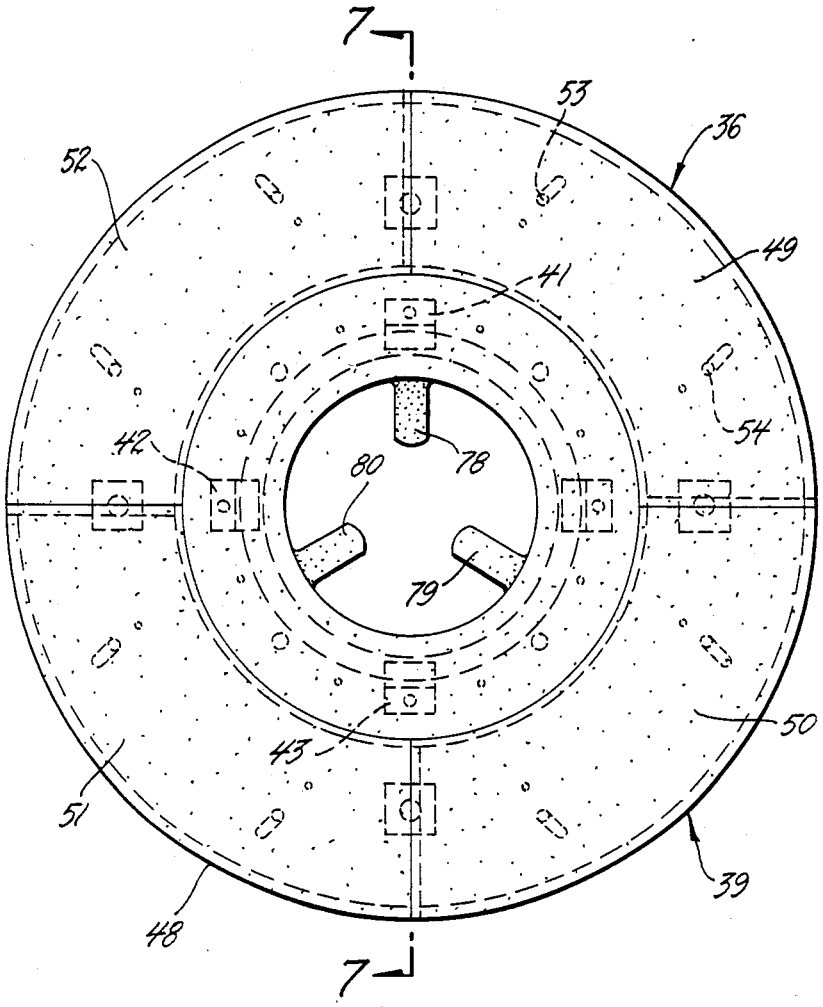
FIG. 6 is a plan view of the suction side liner assembly in FIG. 5 taken along line 6—6.

FIG. 5 illustrates the assembled suction side liner assembly 36 showing how the suction port assembly 37, the wear ring assembly 38, the wear plate assembly 39, and the backing plate assembly 40, are connected together to form a single rigid suction side liner assembly 36 comprised of numerous replaceable components which may be selectively and removably connected and disconnected so as to facilitate individual replacement of each component. FIG. 6 is a plan view of the suction side liner assembly 36 in FIG. 5 taken along line 6—6.

FIG. 4A shows the wear plate assembly 39 in the form of an annular ring having a suction side 44 and an outlet side 45. The wear plate assembly 39 has a hole 46 and an annular wear plate recess 47. In the illustrated embodiment, particularly as shown in FIG. 6, the wear plate assembly 39 includes a wear plate 48 which is made of four individual wear plate sections 49–52 with each wear plate section being provided with a pair of parallel slots recessed to receive a T-slot bolt such as part 52203 on page 15 of the Northwestern catalog number 47, for purposes which will later become apparent. By way of example, two such bolts are identified in FIG. 4A as bolts 53–54. The wear plate 48 is manufactured out of a wear resistant ceramic material. In a slurry pump a ceramic material is employed but the component may be made of other materials such as urethane and rubber in other applications. A typical ceramic may be one comprised of silicon nitride ($Si_3N_4$), magnesium oxide (MgO), aluminum oxide ($Al_2O_3$) and ytterium oxide ($Y_2O_3$).

The wear ring assembly 38 in FIG. 4B includes an annular wear ring in which a first wear surface 29 and a second wear surface 30 are the surfaces which are subjected to greatest wear in the suction side liner assembly 36. It is for this reason that the wear ring 55 is made of the hardest available substances to minimize the effects of abrasion from the slurry, the hardest currently available substance being a carbide as described above.

Figure 12:
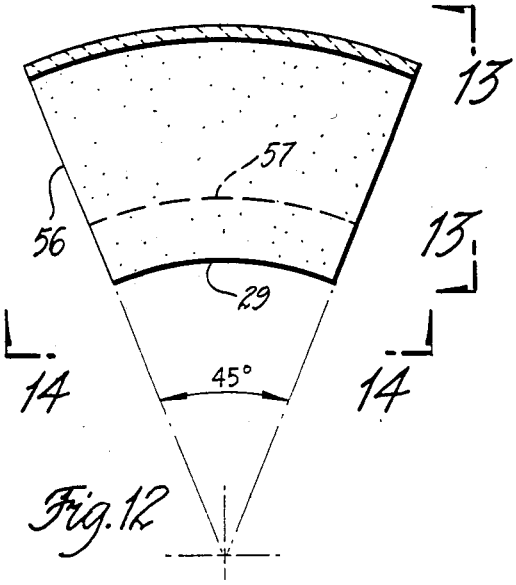
FIG. 12 is a plan view of a wear ring section used in the wear ring assembly of FIG. 4B.
Figure 13:
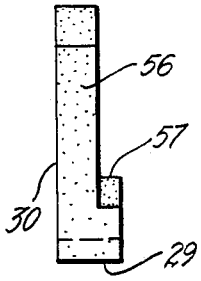
FIG. 13 is an end view of the wear ring section in FIG. 12 taken along line 13—13.
Figure 14:
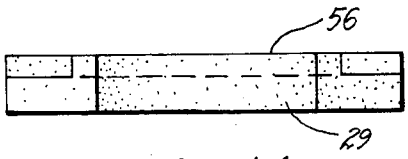
FIG. 14 is an edge view of the wear ring section in FIG. 12 taken along line 14—14.

Details of the wear ring assembly 38 are illustrated in FIGS. 12–16. As shown in FIG. 12, the wear ring assembly 38 in the illustrated embodiment is made out if a series of 8 identical wear ring sections of which secton 56 is illustrated in FIGS. 12–14. Each wear ring section 56 is made of ceramic material due to its outstanding high wear resistant qualities. Such a ceramic is extremely expensive, however, and is difficult to manufacture in large component sizes due to manufacturing considerations, particularly the requirements of pressure and heat in the manufacturing process. As shown in FIG. 13, wear ring section 56 is provided with an annular recess 57 for receiving a wear ring backing ring 58 shown in FIG. 15 in partial cross section. The backing ring 58 is not subjected to slurry abrasiveness so it may be made of a much softer material than the ceramic wear ring section 56, the backing ring 58 in the illustrated embodiment being made of a mild steel. Persons versed in the art will appreciate that there are various ways in which to attach the wear ring section 56 to the backing ring 58 without restricting the spirit of the invention. One way of doing this is to glue the ceramic wear ring section 56 to the mild steel backing ring 58. While the wear ring section 56 is shown in 8 individual sections, it is apparent that the wear ring 55 could be made of a single piece of ceramic if such were cost efficient in the manufacturing process or in the alternative it could be comprised of a fewer number of wear ring sections than the 8 sections required when making them with ends at a 45 degree angle as shown by section 56 in FIG. 12. Persons versed in the art will also appreciate that the backing ring 58 illustrated in FIG. 15 either can be made of a single piece or the backing ring 58 may be made of several discrete sections with each section being of a size to correspond to the wear ring section 56 regardless whether the section extends only 45 degrees around the axis 25 or extends further around the axis 25.

Figure 15:
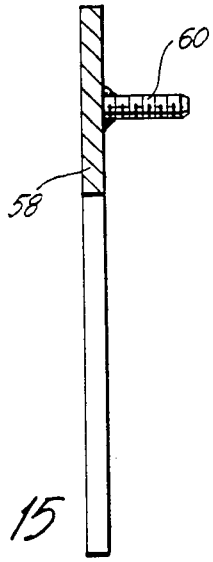
FIG. 15 is a cross section view of the backing ring in the wear ring assembly in FIG. 4B.
Figure 16:
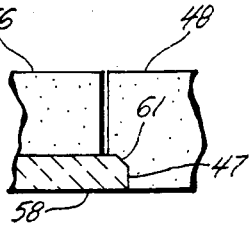
FIG. 16 is an enlarged partial section of the junction between the wear ring assembly in FIG. 4B and the wear plate assembly in FIG. 4A.

As shown in FIGS. 4B and 15, the backing ring 48 includes a backing ring lip 59 having a diameter which corresponds to the wear plate recess 47 shown in FIG. 4A and the diameter of the wear ring 55 on the second wear surface 30 corresponds to the inside diameter of the hole 46 in wear plate assembly 39 so the hole 46 and the wear plate recess 47 receive the wear ring 55 and their inlet and outlet sides being flush with each other as illustrated in FIG. 5. An array of bolts such as the bolt 60 shown in FIG. 15 as provided for selectively and removably attaching the wear ring assembly 38 to the backing plate assembly 40 and will later be referred to as a second connection device. The wear ring backing ring 58 has an outside diameter slightly greater than the outside diameter of the wear ring 55 and is of the same diameter as the wear plate recess 47 so the backing ring 58 is overlapped slightly by the wear plate 48 as shown in FIG. 16, which also illustrates a chamfer on the outlet side of the wear ring backing ring 58 to facilitate assembly.

Figure 10:
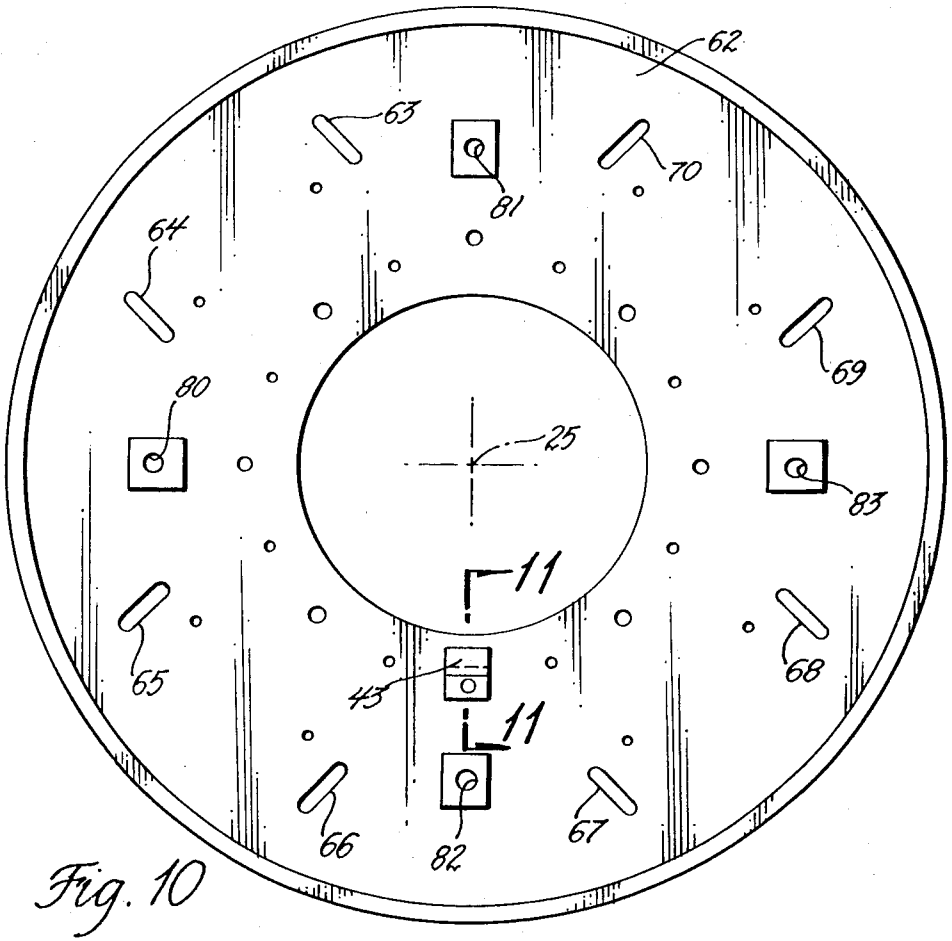
FIG. 10 is a plan view of the backing plate assembly in FIG. 9 taken along line 10—10.
Figure 9:
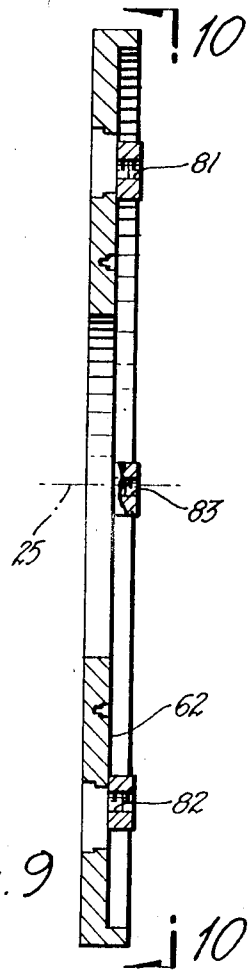
FIG. 9 is an enlarged section view of the backing plate assembly in FIG. 4C.

The backing plate assembly 40 in FIG. 4C is illustrated in greater detail in FIGS. 9–11. The backing plate assembly 40 includes a backing plate 62. A first connection system is provided for securing the suction port assembly 37 to the backing plate assembly 40, and includes 4 hold down clamps including hold down clamps 41–43 shown in FIG. 4E. The hold down clamp detail as shown in FIGS. 10 and 11. As persons versed in the art will appreciate, the hold down clamps 41–43 may be either secured to the backing plate assembly 40 by conventional nuts and bolts or the second connection system which includes the bolts such as the bolt 60 attached to the wear ring backing ring 58 as shown in FIG. 4B may be used to pass through the backing plate 62 and the hold down clamps 42–43.

Figure 17:
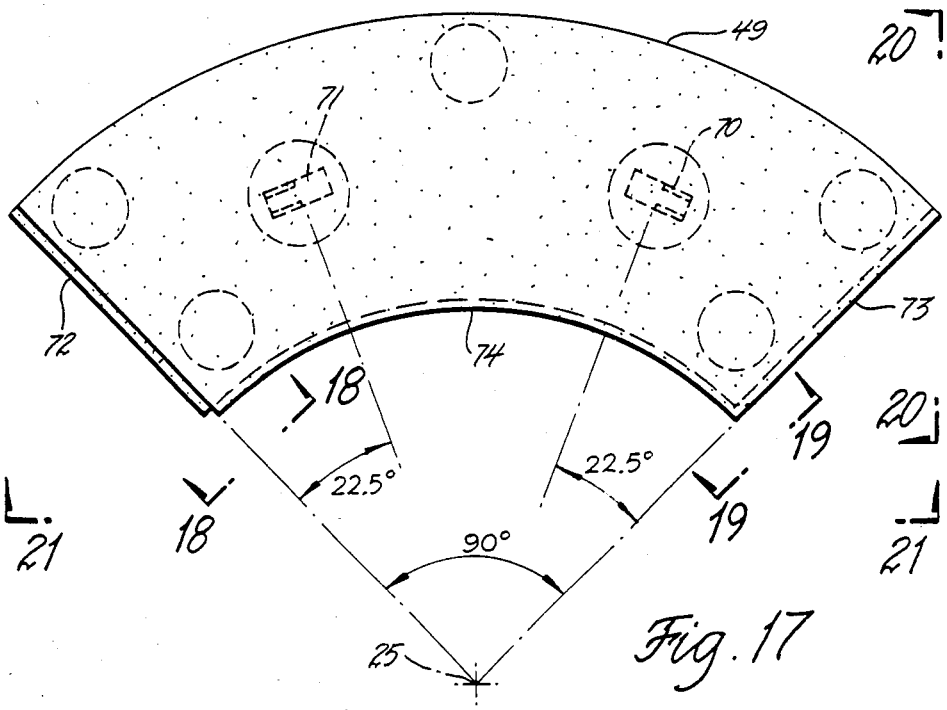
FIG. 17 is a plan view of the wear plate section used in the wear plate assembly in FIG. 4A.

As shown in FIG. 10, 4 pairs of parallel slots 63–70 are provided in the backing plate 62 for receiving the T-slot bolts such as bolt 53 shown in FIG. 4A secured to the wear plate assembly 39. For example, bolts 53 and 54 pass through solts 63 and 64 and are secured in a conventional manner by nuts to the backing plate 62 and provide a third connection system whereby the wear plate 48 may be secured to the backing plate 62. In the illustrated embodiment the wear plate 48 is made in 4 sections with the ends at 90 degrees to each other as illustrated in FIG. 17 where the detail of wear plate section 49 is depicted. Bolts 53 and 54 may be loosened on the nuts which secure them to the backing plate 62 so the wear plate section 49 may be moved radially outward from the axis 25 the length of the slots 63 and 64. As shown in FIGS. 6, the inside diameter of the annular wear plate 48 overlaps the outside diameter of the backing ring lip 59 so when the bolts which attach the wear plate assembly 39 to the backing plate assembly 40 are loosened each of the wear plate sections 49–52 may be slid radially outward so as to expose the respective wear ring section such as wear ring section 56 to facillate removal of any wear ring section which is worn.

Figure 21:
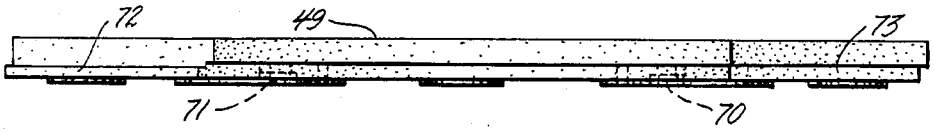
FIG. 21 is an edge view of the wear plate section in FIG. 17 taken along line 21—21.
Figure 18:
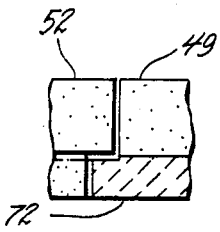
FIG. 18 is a partial cross section view of the wear plate section in FIG. 17 and an adjoining wear plate section taken along line 18—18.
Figure 19:
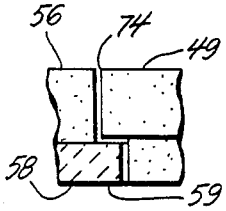
FIG. 19 is a partial section view of the wear plate section in FIG. 17 and an adjoining wear plate section taken along line 19—19.
Figure 20:
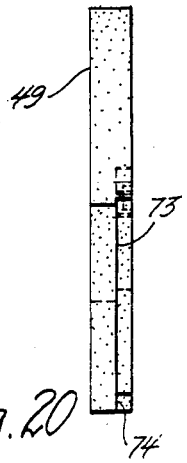
FIG. 20 is an end view of the wear plate section in FIG. 17 taken along line 20—20.

As shown in FIGS. 17–21, wear plate section 49, which is identical to the other wear plate sections 50–52 is provided with two recesses 70–71 for receiving a T-slot bolt in a conventional fashion as previously described. The slots extend substantially at right angles to the radius of wear plate section 49 as shown in FIG. 17. As shown in FIG. 17 wear plate section 49 has first and second ends 72 and 73 which are each notched along a radius from axis 25 as shown in FIG. 18 which is taken along line 18—18 in FIG. 17 to illustrate how wear plate sections 49–52 overlap each other in the preferred embodiment, thereby providing a wear resistant surface even at the point of overlap. Wear plate section 49 besides being notched at ends 72 and 73 is also notched at it's inside radius 74 as shown in FIG. 19 taken along line 19—19 in FIG. 17 so that wear plate section 49 overlaps the backing ring lip 59 of the backing ring 58 except when section 49 is slid radially outward as described previously. The end view of wear plate section 49 is shown in FIG. 23 taken along 20—20 in FIG. 17 and the edge view of wear plate section 49 is shown in FIG. 21 taken along line 21—21 in FIG. 17.

Figure 8:
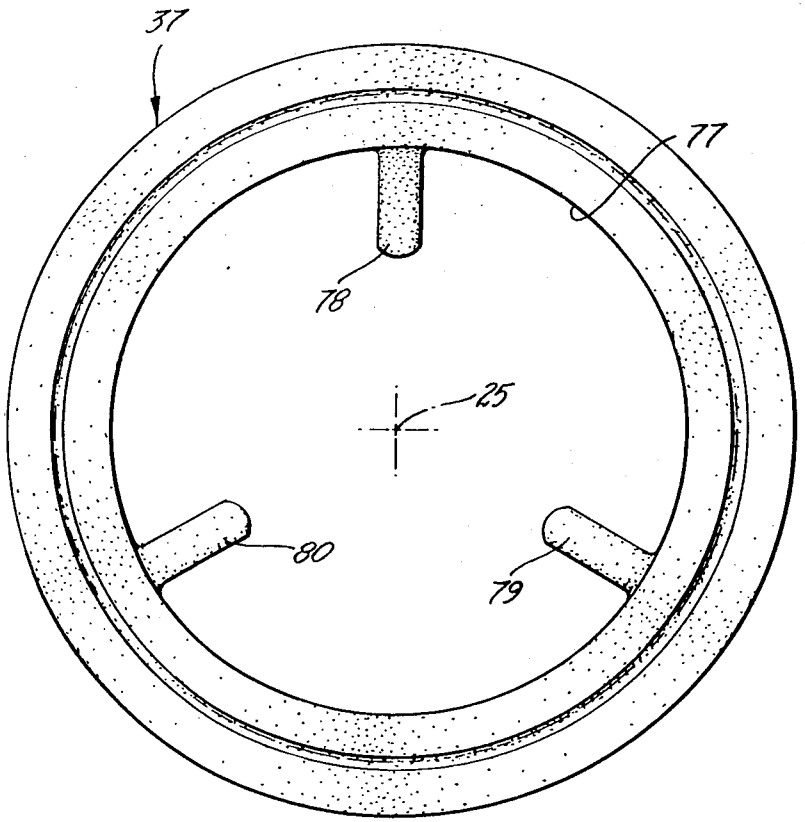
FIG. 8 is a plan view of the suction port assembly in FIG. 7 taken along line 8—8.
Figure 7:
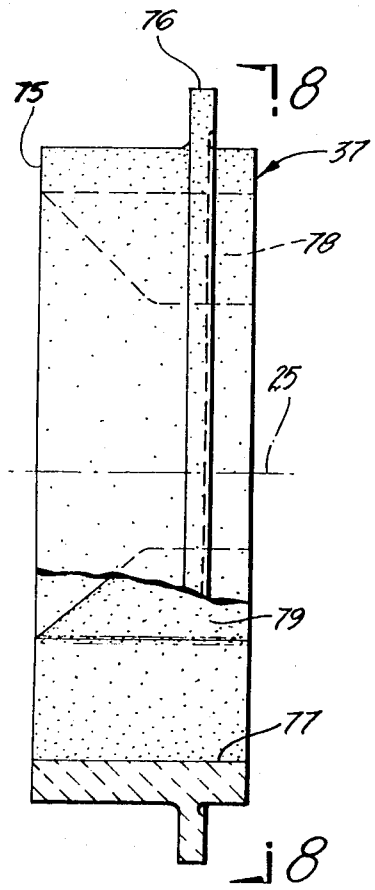
FIG. 7 is an enlarged partial side section view of the suction port assembly in FIG. 6 taken along line 7—7.

The suction port assembly 37 shown in FIG. 4D is shown in greater detail in FIGS. 7–8. The suction port assembly 37 includes a cylindrical suction port 75 having a radially extending flanged lip 76 extending radially outward about the circumference of the suction port 75 so the lip 76 can be engaged by the hold down clamps 41–43 to secure the suction port 75 to the backing plate assembly 40. The inside diameter 77 of suction port assembly 37 is a passageway through which slurry enters the pump 23 and is provided with a set of vanes 78–80 which extend radially inward from the inside diameter 77. Each of the vanes 78–80 are provided to smooth slurry flow to reduce nonlaminary flow. Each of the vanes 78–80 is provided with an inclined surface such as surface 81 on vane 78 to minimize impact of the slurry on the vanes 78–80 as the slurry enters the pump 23.

The suction side liner assembly 36 which is depicted in the assembly drawing in FIG. 4 and which is depicted in the fully assembled position in FIG. 5 and to the suction plate 1 shown in FIG. 1 so as to be rigidly attached to the pump casing shell 4 as shown in FIG. 1. Since the method of attachment of the components together using various bolts and nuts is not unique it is not necessary that every such bolt and nut be shown in the drawings, the various holes for the attaching devices being depicted in FIG. 10, which is a plan view of the backing plate 62 in which for a point of reference the tapped holes 82–85 for receiving bolts 31–34 to secure the backing plate 62 to the suction plate 1 are illustrated.

It is thus apparent that even through it is well known that a suction side liner 2 as shown in FIG. 1 is subjected to rapid wear where the slurry enters the impeller 5 it is impractical to make a large suction side liner out of expensive wear resistant materials and it is similarly impractical to discard an entire suction side liner 2 when it is structurally sound but worn only in the area of the gap formed by positioning suction side liner 2 a predetermined distance from impeller 5. The invention described above greatly reduces the effect of slurry abrasion on the suction side liner assembly 36 by providing three discrete wear resistant surfaces in contact with the slurry as the slurry passes through the pump 23, the surfaces being the inside diameter 77 passageway of the suction port 75, the first and second wear resistant surfaces of the wear ring 55, which are the inside diameter of the wear ring 55 and the surface of wear ring 55 which is proximate the impeller and spaced a predetermined distance so as to prevent any significant slurry flow between the impeller and wear ring 55, and the wear resistant surface of the wear plate 48 proximate the impeller and spaced a predetermined distance from the impeller and positioned flush with the second wear resistant surface of the wear ring 55.

Persons versed in the art will appreciate that technological and metallurgical changes from time to time produce improvements in wear resistant materials and manufacturing processes by which these materials may be made in various size components. Thus the materials which are presently suited for the structures described herein may be replaced by more suitable materials in the future. The wear ring 55 surfaces are subject to the greatest wear due to slurry abrasion and therefore the wear ring 55 at present is manufactured from a silicon material which has been manufactured and sold by Flood Supply Company of Ispheming, Mich. under the trademark of Blackstone PSN which is a composition of silicon nitride, magnesium oxide, aluminum oxide and ytterium oxide. The suction port 75 and the wear plate 48 are subject to abrasion also but are larger components and may be manufactured either of the same ceramic material as the wear ring 55 or may be produced of various wear resistant alloys which are in common use. One such alloy is commonly referred to as "nihard" and is comprised of cast steel, chrome and nickel and is also known in the industry as "high chrome iron" though in various applications it may also be manufactured from rubber, urethane, and ceramic as mentioned above.

Persons versed in the art will appreciate that various changes both as pertains to the materials used and as pertains to structural modifications may be made without departing from the spirit of the invention.

What is claimed is:

1. A slurry pump action side liner for use in a pump having a casing and an impeller defined by an axis in said casing, comprising, in combination, a suction port through which a slurry enters said impeller substantially parallel to said axis; an annular wear ring assembly proximate said impeller positioned between said impeller and said suction port so as to be a certain predetermined distance from said impeller, said predetermined distance being so small as to substantially prevent said slurry passing between said wear ring assembly and said impeller; an annular wear plate assembly positioned so as to substantially surround said wear ring assembly and positioned substantially at said predetermined distance from said impeller; and connection means for rigidly and removably connecting said wear plate assembly, said wear ring assembly and said suction port to said casing whereby a slurry which enters said suction port passes through said wear ring assembly and said wear plate assembly into said impeller and said suction port, and said wear ring assembly and said wear plate assembly may be selectively removed and replaced.

2. A slurry pump comprising, in combination, an impeller for pumping a slurry; a casing for housing and supporting said impeller, said casing including an outlet through which a slurry exits said casing and an inlet through which a slurry enters said casing; and a suction side liner assembly for directing flow of a slurry through said casing inlet into said impeller, said suction side liner assembly including a suction port assembly including an annular suction port and a hole defined by an axis and surrounded by said suction port, an annular wear ring assembly substantially defined by said axis and substantially positioned between said suction port and said impeller for receiving slurry flow from said suction port and for directing said slurry flow into said impeller, said wear ring assembly including a wear resistant surface positioned a predetermined distance from said impeller, said predetermined distance being insufficient to permit any substantial slurry flow between said impeller and said wear ring assembly, an annular wear plate assembly substantially defined by said axis and having a wear resistant surface proximate said impeller and spaced substantially said predetermined distance from said impeller, said predetermined distance being insufficient to permit any substantial slurry flow between said impeller and said wear plate assembly, a backing plate assembly for supporting said suction port, said wear ring assembly and said wear plate assembly and for removably connecting said suction port, said wear ring assembly and said wear plate assembly to said casing so as to rigidly support said wear ring assembly wear resistant surface and said wear plate assembly wear resistant surface said predetermined distance from said impeller, first connection means for selectively connecting said suction port assembly to said backing plate assembly, thereby permitting selective replacement of said suction port assembly, second connection means for selectively connecting said wear ring assembly to said backing plate assembly, thereby permitting selective replacement of said wear ring assembly, third connection means for selectively connecting said wear plate assembly to said backing plate assembly, thereby permitting selective replacement of said wear plate assembly, and fourth connection means for selectively connecting said backing plate assembly to said casing so as to support said wear ring assembly wear resistant surface and said wear plate assembly wear resistant surface substantially at said predetermined distance from said impeller whereby said suction port assembly, said wear ring assembly and said wear plate assembly may each be selectively disconnected from said casing and may be selectively replaced.

3. A slurry pump suction side liner for guiding slurry flow into a casing containing an impeller having an inlet defined by an axis and an impeller suction side surface comprising, in combination, a suction port assembly for guiding slurry into said casing, a wear ring assembly between said suction port assembly and said impeller suction side surface for guiding said slurry into said impeller inlet, said wear ring assembly including a highly wear resistant surface positioned proximate said impeller inlet and positioned a predetermined distance from said impeller suction side surface so as to form a predetermined gap between said impeller suction side surface and said wear ring assembly wear resistant surface, said predetermined distance being selected so as to substantially preclude slurry flow through said gap between said impeller suction side surface and said wear ring assembly wear resistant surface; a wear plate assembly for extending said gap substantially radially from said axis, said wear plate assembly having a wear resistant surface substantially flush with said wear ring assembly resistant wear surface and being positioned substantially said predetermined distance from said impeller suction side surface; and support means for selectively and removably connecting and supporting said suction port assembly, said wear ring assembly and said wear plate assembly into a single suction side liner assembly structure attachable to said casing whereby said suction side liner may be removed from said casing and disassembled so that each component of said suction port assembly, said wear ring assembly and said wear plate assembly may be selectively replaced and said suction side liner may be reassembled and reinstalled in said casing using replaced components.

4. A slurry pump suction side liner assembly for guiding a slurry through a pump casing inlet defined by an axis into an impeller having an impeller inlet and a suction side surface comprising, in combination, a suction port assembly having an inlet substantially defined by said axis; a wear ring assembly positioned between said suction port assembly and said impeller suction side surface for guiding slurry flow from said suction port assembly into said impeller inlet, said wear ring assembly including an annular wear ring extending substantially radially outward from said axis having a first wear resistant surface substantially parallel to said to axis proximate said suction port and a second wear resistant surface extending substantially radially from said axis proximate said impeller suction side surface and spaced a predetermined distance from said impeller suction side surface so as to form a predetermined gap between said impeller suction side surface and said second wear ring wear resistant surface, said gap predetermined distance being selected so as to substantially preclude slurry flow through said gap; a wear plate assembly for extending said gap substantially radially outward from said axis, said wear plate assembly including an annular wear plate, said wear plate having a wear resistant surface proximate said impeller and spaced from said impeller suction side surface said predetermined distance so as to extend said gap substantially radially outward between said impeller suction side surface and said wear plate wear resistant surface; and a backing plate assembly for supporting and connecting said suction port assembly, said wear ring assembly and said wear plate assembly into a rigid suction side liner assembly, said backing plate assembly including an annular backing plate, a first connection means for selectively and removably connecting said suction port assembly to said backing plate, a second connection means for selectively and removably connecting said wear ring assembly to said backing plate, a third connection means for selectively and removably connecting said wear plate assembly to said backing plate, and a fourth connection means for selectively and removably connecting said backing plate to said casing whereby said suction side liner assembly may be selectively removed from said casing and disassembled so as to facilitate said suction port assembly, said wear ring assembly, said wear plate assembly and said backing plate assembly each being selectively replaced and said suction side liner assembly may be reassembled and reinstalled in said casing using selectively replaced components.

5. A slurry pump suction side liner assembly for guiding a slurry through a pump casing inlet defined by an axis into an impeller having an impeller inlet and a suction side surface comprising in combination, a suction port assembly having an inlet substantially defined by said axis; a wear ring assembly positioned between said suction port assembly and said impeller suction side surface for guiding slurry flow from said suction port assembly into said impeller inlet, said wear ring assembly including an annular wear ring extending substantially radially outward from said axis having a first wear resistant surface substantially parallel to said to axis proximate said suction port and a second wear resistant surface proximate said impeller suction side surface and spaced a predetermined distance from said impeller suction side surface so as to form a predetermined gap between said impeller suction side surface and said second wear ring wear resistant surface, said gap predetermined distance being selected so as to substantially preclude slurry flow through said gap; said annular wear ring including at least two wear ring sections with each wear ring section having a first and second end with the first end of the first wear ring section being proximate the second end of a second wear ring section so as to form an annular wear ring comprised of wear ring sections positioned substantially end to end, said wear ring assembly also including an annular backing ring substantially defined by said axis and means for attaching each wear ring sections to said backing ring so as to rigidly support said wear ring sections in the form of a rigid annular wear ring, each wear ring section having a first wear resistant surface substantially parallel to said axis proximate said suction port and a second wear resistant surface proximate said impeller suction side surface and spaced a predetermined distance from said impeller suction side surface so as to form a predetermined gap between said impeller suction side surface and said second wear ring section wear resistant surface, said gap predetermined distance being selected so as to substantially preclude slurry flow through said gap; a wear plate assembly for extending said gap substantially radially outward from said axis, said wear plate assembly including an annular wear plate, said wear plate having a wear resistant surface proximate said impeller and spaced from said impeller suction side surface said predetermined distance so as to extend said gap substantially radially outward between said impeller suction side surface and said wear plate wear resistant surface; and a backing plate assembly for supporting and connecting said suction port assembly, said wear ring assembly and said wear plate assembly into a rigid suction side liner assembly, said backing plate assembly including an annular backing plate, a first connection means for selectively and removably connecting said suction port assembly to said backing plate, a second connection means for selectively and removably connecting said wear ring assembly to said backing plate, a third connection means for selectively and removably connecting said wear plate assembly to said backing plate, and a fourth connection means for selectively and removably connecting said backing plate to said casing whereby said suction side liner assembly may be selectively removed from said casing and disassembled so as to facilitate said suction port assembly, said wear ring assembly, said wear plate assembly and said backing plate assembly each being selectively replaced and said suction side liner assembly may be reassembled and reinstalled in said casing using selectively replaced components.

6. A slurry pump suction side liner assembly for guiding a slurry through a pump casing inlet defined by an axis into an impeller having an impeller inlet and a suction side surface comprising, in combination, a suction port assembly having an inlet substantially defined by said axis; a wear ring assembly positioned between said suction port assembly and said impeller suction side surface for guiding slurry flow from said suction port assembly into said impeller inlet, said wear ring assembly including a ceramic annular wear ring extending substantially radially outward froms aid axis having a first wear resistant surface substantially parallel to said to axis proximate said suction port and a second wear resistant surface proximate said impeller suction side surface and spaced a predetermined distance from said impeller suction side surface so as to form a predetermined gap between said impeller suction side surface and said second wear ring wear resistant surface, said gap predetermined distance being selected so as to substantially preclude slurry flow through said gap; said annular wear ring including at least two wear ring sections with each wear ring section having a first and second end with the first end of a first wear ring section being proximate the second end of a second wear ring section so as to form an annular wear ring comprised of wear ring sections positioned substantially end to end, said wear ring assembly also including an annular bacing ring substantially defined by said axis and means for attaching each wearing section to said backing ring so as to rigidly support said wear ring sections in the form of a rigid annular wear ring, each wear ring section having a first wear resistant surface substantially parallel to said axis proximate said suction port and a second wear resistant surface proximate said impeller suction side surface and spaced predetermined distance from said impeller suction side surface so as to form a predetermined gap between said impeller suction side surface and said second wear ring section wear resistant surface, said gap predetermined distance being selected so as to substantially preclude slurry flow through said gap; a wear plate assembly for extending said gap substantially radially outward from said axis, said wear plate assembly including an annular wear plate, said wear plate having a wear resistant surface proximate said impeller and spaced from said impeller suction side surface said predetermined distance so as to extend said gap substantially radially outward between said impeller suction side surface and said wear plate wear resistant surface; and a backing plate assembly for supporting and connecting said suction port assembly, said wear ring assembly and said wear plate assembly into a rigid suction side liner assembly, said backing plate assembly including an annular backing plate, a first connection means for selectively and removably connecting said suction port assembly to said backing plate, a second connection means for selectively and removably connecting said wear ring assembly to said backing plate, a third connection means for selectively and removably connecting said wear plate assembly to said backing plate, and a fourth connection means for selectively and removably connecting said backing plate to said casing whereby said suction side liner assembly may be selectively removed from said casing and disassembled so as to facilitate said suction port assembly, said wear ring assembly, said wear plate assembly and said backing plate assembly each being selectively replaced and said suction side liner assembly may be reassembled and reinstalled in said casing using selectively replaced components.

7. A slurry pump suction side liner assembly for guiding a slurry through a pump casing inlet defined by an axis into an impeller having an impeller inlet and a suction side surface comprising, in combination, a suction port assembly having an inlet substantially defined by said axis; a wear ring assembly positioned between said suction port assembly and said impeller suction side surface for guiding slurry flow from said suction port assembly into said impeller inlet, said wear ring assembly including an annular wear ring extending substantially radially outward from said axis having a first wear resistant surface substantially parallel to said to axis proximate said suction port and a second wear resistant surface proximate said impeller suction side surface and spaced a predetermined distance from said impeller suction side surface so as to form a predetermined gap between said impeller suction side surface and said second wear ring wear resistant surface, said gap predetermined distance being selected so as to substantially preclude slurry flow through said gap; a wear plate assembly for extending said gap substantially radially outward from said axis, said wear plate assembly including an annular wear plate, said wear plate having a wear resistant surface proximate said impeller and spaced from said impeller suction side surface said predetermined distance so as to extend said gap substantially radially outward between said impeller suction side surface and said wear plate wear resistant surface, said wear plate including at least two wear plate sections, each of said wear plate sections having a first end and a second end and being positioned so that the first end of one of said wear plate sections is proximate the second end of another of said wear plate sections so that said wear plate sections are positioned end to end so as to form said annular wear plate, each of said wear plate sections including a wear resistant surface positioned proximate said impeller and spaced from said impeller suction side surface said predetermined distance so as to extend said gap substantially radially outward between said impeller suction side surface and said wear plate section wear resistant surface; and a backing plate assembly for supporting and connecting said suction port assembly, said wear ring assembly and said wear plate assembly into a rigid suction side liner assembly, said backing plate assembly including an annular backing plate, a first connection means for selectively and removably connecting said suction port assembly to said backing plate, a second connection means for selectively and removably connecting said wear ring assembly to said backing plate, a third connection means for selectively and removably connecting said wear plate assembly to said backing plate, and a fourth connection means for selectively and removably connecting said backing plate to said casing whereby said suction side liner assembly may be selectively removed from said casing and disassembled so as to facilitate said suction port assembly, said wear ring assembly, said wear plate assembly and said backing plate assembly each being selectively replaced and said suction side liner assembly may be reassembled and reinstalled ins aid casing using selectively replaced components.

8. A slurry pump suction side liner assembly for guiding a slurry through a pump casing inlet defined by an axis into an impeller having an impeller inlet and a suction side surface comprising, in combination, a suction port assembly having an inlet substantially defined by said axis; a wear ring assembly positioned between said suction port assembly and said impeller suction side surface for guiding slurry flow from said suction port assembly into said impeller inlet, said wear ring assembly including a ceramic annular wear ring extending substantially radially outward from said axis having a first wear resistant surface substantially parallel to said to axis proximate said suction port and a second wear resistant surface proximate said impeller suction side surface and spaced a predetermined distance from said impeller suction side surface so as to form a predetermined gap between said impeller suction side surface and said second wear ring wear resistant surface,s aid gap predetermined distance being selected so as to substantially precluse slurry flow through said gap; a wear plate assembly for extending said gap substantially radially outward from said axis, said wear plate assembly including an annular wear plate, said wear plate having a wear resistant surface proximate said impeller and spaced from said impeller suction side surface said predetermined distance so as to extend said gap substantially radially outward between said impeller suction side surface and said wear plate wear resistant surface, said wear plate including at least two wear plate sections, each of said wear plate sections having a first end and a second end and being positioned so that the first end of one of said wear plate sections is proximate the second end of another of said wear plate sections so that said wear plate sections are positioned end to end so as to form said annular wear plate, each of said wear plate sections including a wear resistant surface positioned proximate said impeller and spaced from said impeller suction side surface said predetermined distance so as to extend said gap substantially radially outward between said impeller suction side surface and said wear plate section wear resistant surface; and a backing plate assembly for supporting and connecting said suction port assembly, said wear ring assembly and said wear plate assembly into a rigid suction side liner assembly, said backing plate assembly including an annular backing plate, a first connection means for selectively and removably connecting said suction port assembly to said backing plate, a second connection means for selectively and removably connecting said wear ring assembly to said backing plate, a third connection means for selectively and removably connecting said wear plate assembly to said backing plate, and a fourth connection means for selectively and removably connecting said backing plate to said casing whereby said suction side liner assembly may be selectively removed from said casing and disassembled so as to facilitate said suction port assembly, said wear ring assembly, said wear plate assembly and said backing plate assembly each being selectively replaced and said suction side liner assembly may be reassembled and reinstalled in said casing using selectively replaced components.

9. A slurry pump suction side liner assembly for guiding a slurry through a pump casing inlet defined by an axis into an impeller having an impeller inlet and a suction side surface comprising, in combination, a suction port assembly having an inlet substantially defined by said axis; a wear ring assembly positioned between said suction port assembly and said impeller suction side surface for guiding slurry flow from said suction port assembly into said impeller inlet, said wear ring assembly including an annular wear ring extending substantially radially outward from said axis having a first wear resistant surface substantially parallel to said to axis proximate said suction port and a second wear resistant surface proximate said impeller suction side surface and spaced a predetermined distance from said impeller suction side surface so as to form a predetermined gap between said impeller suction side surface and said second wear ring wear resistant surface, said gap predetermined distance being selected so as to substantially preclude slurry flow through said gap, and a backing ring, said backing ring including a backing ring lip which extends radially outward from said axis outside the perimeter of said wear ring so as to extend radially beyond the wear ring by a certain distance; a wear plate assembly for extending said gap substantially radially outward from said axis, said wear plate assembly including an annular wear plate, said wear plate having a wear resistant surface proximate said impeller and spaced from said impeller suction side surface said predetermined distance so as to extend said gap substantially radially outward between said impeller suction side surface and said wear plate wear resistant surface, said wear plate including at least two wear plate sections, each of said wear plate sections having a first end and a second end and being positioned so that the first end of one of said wear plate sections is proximate the second end of another of said wear plate sections so that said wear plate sections are positioned end to end so as to form said annular wear plate, each of said wear plate sections including a wear resistant surface positioned proximate said impeller and spaced from said impeller suction side surface said predetermined distance so as to extend said gap substantially radially outward between said impeller suction side surface and said wear plate section wear resistant surface, said wear plate sections each including an annular wear plate recess which is recessed radially said certain distance for receiving said backing ring lip; and a backing plate assembly for supporting and connecting said suction port assembly, said wear ring assembly and said wear plate assembly into a rigid suction side liner assembly, said backing plate assembly including an annular backing plate, a first connection means for selectively and removably connecting said suction port assembly to said backing plate, a second connection means for selectively and removably connecting said wear ring assembly to said backing plate, a third connection means for selectively and removably connecting said wear plate assembly to said backing plate, said third connection means including means for selectively sliding said wear plate sections radially in excess of said certain distance whereby each of said wear plate sections may be placed in a first position in which said wear plate recess engages said backing ring lip and in a second position in which said wear plate recess does not engage said backing ring lip so as to facilitate said second connection means selectively disconnecting each of said wear ring sections from said backing plate and removing said disconnected wear ring section from said backing ring through said wear plate assembly, and a fourth connection means for selectively and removably connecting said backing plate to said casing whereby said suction side liner assembly may be selectively removed from said casing and disassembled so as to facilitate said suction port assembly, said wear ring assembly, said wear plate assembly and said backing plate assembly each being selectively replaced and said suction side liner assembly may be reassembled and reinstalled in said casing using selectively replaced components.

10. A slurry pump suction side liner assembly for guiding a slurry through a pump casing inlet defined by an axis into an impeller having an impeller inlet and a suction side surface comprising, in combination, a suction port assembly having an inlet substantially defined by said axis, said suction port assembly including an annular suction port which defines a passageway defined by said axis through which said slurry may flow into said impeller and said suction port assembly includes at least one vane extending radially inward from said annular suction port toward said axis for reducing non-laminar flow in said slurry, said suction port including an annular suction port lip radially extending outward from the surface of said suction port, a wear ring assembly positioned between said suction port assembly and said impeller suction side surface for guiding slurry flow from said suction port assembly into said impeller inlet, said wear ring assembly including a ceramic annular wear ring extending substantially radially outward from said axis having a first wear resistant surface substantially parallel to said to axis proximate said suction port and a second wear resistant surface proximate said impeller suction side surface and spaced a predetermined distance from said impeller suction side surface so as to form a predetermined gap between said impeller suction side surface and said second wear ring wear resistant surface, said gap predetermined distance being selected so as to substantially preclude slurry flow through said gap, said backing ring including a backing ring lip which extends radially outward from said axis outside the perimeter of the wear ring so as to extend radially beyond the wear ring by a certain distance; a wear plate assembly for extending said gap substantially radially outward from said axis, said wear plate assembly including an annular wear plate, said wear plate having a wear resistant surface proximate said impeller and spaced from said impeller suction side surface said predetermined distance so as to extend said gap substantially radially outward between said impeller suction side surface and said wear plate wear resistant surface, said wear plate including at least two wear plate sections, each of said wear plate sections having a first end and a second end and being positioned so that the first end of one of said wear plate sections is proximate the second end of another of said wear plate sections so that said wear plate sections are positioned end to end so as to form said annular wear plate, each of said wear plate sections including a wear resistant surface positioned proximate said impeller and spaced from said impeller suction side surface said predetermined distance to as to excent said gap substantially radially outward between said impeller suction side surface and said wear plate section wear resistant surface, said wear plate sections each including an annular wear plate recess which is recessed radially said certain distance for receiving said backing ring lip; and a backing plate assembly for supporting and connecting said suction port assembly, said wear ring assembly and said wear plate assembly into a rigid suction side liner assembly, said backing plate assembly including an annular backing plate, a first connection means for selectively and removably connecting said suction port assembly to said backing plate, said first connection means including at least one hold down clamp for securing said suction port lip to said backing plate, a second connection means for selectively and removably connecting said wear ring assembly to said backing plate, a third connection means for selectively and removably connecting said wear plate assembly to said backing plate, said third connection means including means for selectively sliding said wear plate sections radially in excess of said certain distance whereby each of said wear plate sections may be placed in a first position in which said wear plate recess engages said backing ring lip and in a second position in which said wear plate recess does not engage said backing ring lip so as to facilitate said second connection means selectively disconnecting each of said wear ring sections from said backing plate and removing said disconnected wear ring section from said backing plate through said wear plate assembly, and a fourth connection means for selectively and removably connecting said backing plate to said casing whereby said suction side liner assembly may be selectively removed from said casing and disassembled so as to facilitate said suction port assembly, said wear ring assembly, said wear plate assembly and said backing plate assembly each being selectively replaced and said suction side liner assembly may be reassembled and reinstalled in said casing using selectively replaced components.

* * * * *